US011255300B2

(12) United States Patent
Ueda

(10) Patent No.: US 11,255,300 B2
(45) Date of Patent: Feb. 22, 2022

(54) DIESEL ENGINE

(71) Applicant: MITSUBISHI HEAVY INDUSTRIES ENGINE & TURBOCHARGER, LTD., Sagamihara (JP)

(72) Inventor: Hiroyuki Ueda, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 17/216,058

(22) Filed: Mar. 29, 2021

(65) Prior Publication Data

US 2021/0215123 A1 Jul. 15, 2021

Related U.S. Application Data

(62) Division of application No. 16/492,030, filed as application No. PCT/JP2018/005557 on Feb. 16, 2018, now abandoned.

(51) Int. Cl.
*F02M 26/28* (2016.01)
*F02M 26/33* (2016.01)
(Continued)

(52) U.S. Cl.
CPC ..... *F02M 26/33* (2016.02); *F02M 26/28* (2016.02); *F02M 26/32* (2016.02); *F02M 26/35* (2016.02); *F02M 26/74* (2016.02)

(58) Field of Classification Search
CPC ..... F02M 26/28; F02M 26/32; F02M 26/33; F02M 26/35; F02M 26/49; F02M 26/50; F02M 26/72
See application file for complete search history.

(56) References Cited

U.S. PATENT DOCUMENTS 6,904,898 B1 * 6/2005 Sahlen ..... F02M 26/50 123/568.12
7,299,771 B2 * 11/2007 Wei ..... F01P 3/02 123/41.08
(Continued)

FOREIGN PATENT DOCUMENTS

JP 2000-130266 A 5/2000
JP 2004-204828 A 7/2004
(Continued)

OTHER PUBLICATIONS

Written Opinion of the International Searching Authority and English translation of the International Search Report, dated Apr. 10, 2018, for International Application No. PCT/JP2018/005557, with an English translation of the Written Opinion of the International Searching Authority.

*Primary Examiner* — Kevin R Steckbauer
(74) *Attorney, Agent, or Firm* — Birch, Stewart, Kolasch & Birch, LLP

(57) ABSTRACT

A diesel engine is provided with an EGR line G3 configured to recirculate a portion of exhaust gas, discharged from an engine body 11, to the engine body 11 as combustion gas, an EGR cooler 16 provided in the EGR line G3 and configured to cool exhaust gas by coolant, a coolant supply device configured to supply coolant to the EGR cooler 16, and a control device 30 configured to activate the coolant supply device when the engine body 11 is in operation and a temperature of the engine body 11 is lower or equal to a preset prescribed temperature.

12 Claims, 4 Drawing Sheets

(51) Int. Cl.

| | |
|---|---|
| ***F02M 26/74*** | (2016.01) |
| ***F02M 26/32*** | (2016.01) |
| ***F02M 26/35*** | (2016.01) |

(56) References Cited

U.S. PATENT DOCUMENTS

| | | | | |
|---|---|---|---|---|
| 7,921,829 | B2 * | 4/2011 | Hayashi | F01P 7/16 123/568.12 |
| 7,971,577 | B2 * | 7/2011 | Styles | F02M 26/50 123/568.12 |
| 8,146,542 | B2 * | 4/2012 | Cattani | F02M 26/24 123/41.29 |
| 8,250,867 | B2 * | 8/2012 | Kardos | F02M 26/25 60/605.2 |
| 8,434,432 | B2 * | 5/2013 | Magro | F01N 3/04 123/41.1 |
| 8,763,394 | B2 * | 7/2014 | Freund | F02M 26/05 60/605.2 |
| 8,903,631 | B2 * | 12/2014 | Klingbeil | F02M 26/33 701/108 |
| 8,903,632 | B2 * | 12/2014 | Peters | F02D 41/0055 701/108 |
| 9,212,630 | B2 * | 12/2015 | Peters | F02D 41/0055 |
| 9,528,475 | B2 * | 12/2016 | Styles | F02M 25/0227 |
| 9,890,756 | B2 * | 2/2018 | Sundemo | F01P 11/20 |
| 10,012,132 | B2 * | 7/2018 | Yumisashi | F01P 11/14 |
| 10,041,451 | B2 * | 8/2018 | Zhang | F01N 5/025 |
| 10,047,704 | B2 * | 8/2018 | Takahashi | F02M 26/33 |
| 10,167,759 | B2 * | 1/2019 | Hebert | F01P 11/20 |
| 10,302,048 | B2 * | 5/2019 | Zhang | F02D 41/0007 |
| 10,316,801 | B2 * | 6/2019 | Zhang | F02M 26/24 |
| 10,563,623 | B2 * | 2/2020 | Shinagawa | F02M 26/37 |
| 11,022,021 | B2 * | 6/2021 | Quix | F01P 7/14 |
| 11,047,291 | B2 * | 6/2021 | Matsumoto | F01P 7/165 |
| 2007/0157893 | A1 * | 7/2007 | Wei | F01P 3/02 123/41.08 |
| 2009/0114171 | A1 * | 5/2009 | Hayashi | F01P 3/02 123/41.44 |
| 2009/0320467 | A1 * | 12/2009 | Kardos | F02M 26/24 60/605.2 |
| 2010/0058748 | A1 * | 3/2010 | Styles | F02M 26/28 60/310 |
| 2011/0023796 | A1 * | 2/2011 | Cattani | F01P 7/165 123/41.1 |
| 2011/0107983 | A1 * | 5/2011 | Magro | F02M 26/25 123/41.1 |
| 2012/0323465 | A1 * | 12/2012 | Peters | F02M 26/33 701/104 |
| 2012/0323470 | A1 * | 12/2012 | Klingbeil | F02D 41/405 701/108 |
| 2016/0333829 | A1 * | 11/2016 | Takahashi | F01P 7/16 |
| 2017/0016381 | A1 * | 1/2017 | Yumisashi | F16K 31/0675 |
| 2017/0058754 | A1 * | 3/2017 | Hebert | F01N 3/021 |
| 2017/0335805 | A1 * | 11/2017 | Zhang | F01N 3/20 |
| 2018/0202396 | A1 * | 7/2018 | Zhang | F02M 26/47 |
| 2018/0313300 | A1 * | 11/2018 | Zhang | F01N 5/025 |
| 2019/0186430 | A1 * | 6/2019 | Shinagawa | F28F 27/00 |
| 2020/0063636 | A1 * | 2/2020 | Quix | F01P 5/10 |
| 2020/0141366 | A1 * | 5/2020 | Quix | F02M 26/06 |
| 2021/0040878 | A1 * | 2/2021 | Matsumoto | F01P 7/14 |

FOREIGN PATENT DOCUMENTS

| | | | |
|---|---|---|---|
| JP | 2010-133287 | A | 6/2010 |
| JP | 2011-132852 | A | 7/2011 |
| JP | 2012-219777 | A | 11/2012 |
| JP | 2014-109208 | A | 6/2014 |
| JP | 2014-222034 | A | 11/2014 |
| JP | 2016-79898 | A | 5/2016 |
| JP | 2016-89777 | A | 5/2016 |
| WO | WO 2016/103393 | A1 | 6/2016 |

* cited by examiner

DIESEL ENGINE

CROSS-REFERENCE TO RELATED APPLICATIONS

This application is a Divisional Application of U.S. application Ser. No. 16/492,030, filed on Sep. 6, 2019, which is the National Phase under 35 U.S.C. § 371 of International Application No. PCT/JP2018/005557, filed on Feb. 16, 2018, which claims the benefit under 35 U.S.C. § 119(a) to Patent Application No. 2017-054754, filed in Japan on Mar. 21, 2017, all of which are hereby expressly incorporated by reference into the present application.

TECHNICAL FIELD

The present invention relates to a diesel engine equipped with an exhaust gas recirculation device.

BACKGROUND ART

In order to reduce NOx in exhaust gas, exhaust gas recirculation (EGR) is used. In the EGR, a portion of the exhaust gas discharged to an exhaust line from a combustion chamber of a diesel engine is diverted to an exhaust gas recirculation line, mixed with combustion air to form a combustion gas, and then returned to the combustion chamber. As a result, an oxygen concentration of the combustion gas is reduced, a combustion temperature is lowered by reducing the speed of combustion, which is a reaction between fuel and oxygen, and an amount of NOx generation can be reduced.

In the EGR, since a part of the exhaust gas is mixed into the combustion air, the exhaust gas is mixed into the combustion air after being cooled in an EGR cooler in order to suppress a decrease of intake charging efficiency. In this case, the EGR cooler generally uses engine coolant to cool exhaust gas. An example of such an exhaust gas recirculation device is disclosed in Patent Document 1 described below.

CITATION LIST

Patent Literature

Patent Document 1: JP 2000-130266 A

SUMMARY OF INVENTION

Technical Problem

By the way, the exhaust gas discharged from a diesel engine includes a particulate matter (PM), and this particulate matter is soot that is produced from fuel burned incompletely. As a result, when the EGR cooler cools the exhaust gas using engine coolant, soot in the exhaust gas is adhered to a heat transfer pipe and deposited, thereby reducing cooling efficiency.

The present invention solves the problems described above and has an object of providing a diesel engine in which performance reduction due to deposits on an EGR cooler is suppressed.

Solution to Problem

A diesel engine of the present invention for achieving the above-described object includes: an EGR line configured to recirculate a portion of exhaust gas, discharged from an engine body, to the engine body as a combustion gas; an EGR cooler provided in the EGR line and configured to cool exhaust gas by coolant; a coolant supply device configured to supply coolant to the EGR cooler; and a control device configured to activate the coolant supply device when the engine body is in operation and a temperature of the engine body is lower than or equal to a preset prescribed temperature.

Accordingly, the coolant is supplied to the EGR cooler by activating the coolant supply device when the engine body is in operation and the temperature of the engine body is lower than or equal to a prescribed temperature. Since the exhaust gas contains water vapor, soot that has stuck to the outer surface of a heat transfer pipe constituting the EGR cooler also contains water vapor. When the heat transfer pipe is cooled by a low-temperature coolant, the soot that has stuck to the heat transfer pipe is cooled, whereby the water vapor therein is turned into condensed water. When the condensed water is produced in the soot, its volume expands and the deposit layer of the soot stuck to the heat transfer pipe becomes more likely to be peeled off by being lifted by the condensed water. Here, when the exhaust gas comes into contact with the soot deposit layer on the heat transfer pipe, the peeling-off of the soot deposit layer is facilitated due to a contact pressure of the exhaust gas, and the soot is removed by being peeled off from the outer surface of the heat transfer pipe. As a result, performance reduction due to deposits on the EGR cooler can be suppressed.

In the diesel engine of the present invention, an EGR valve is provided in the EGR line, and the control device is configured to activate the coolant supply device when the EGR valve is open, when the engine body is in operation and a temperature of the engine body is lower than or equal to the prescribed temperature.

Accordingly, the coolant is supplied to the EGR cooler when the EGR valve is open, when the engine body is in operation and a temperature of the engine body is lower than or equal to the prescribed temperature. Since the exhaust gas comes into contact with the soot deposit layer in a state in which the soot stuck to the heat transfer pipe is cooled and more likely to be peeled off, the contact pressure of the exhaust gas enables the soot to be removed by being peeled off from the outer surface of the heat transfer pipe at an early stage.

In the diesel engine of the present invention, the coolant supply device is constituted of an exhaust gas cooling line configured to supply coolant of a water jacket of the engine body to the EGR cooler and a coolant pump provided in the exhaust gas cooling line, and the control device activates the coolant pump when the engine body is in operation and a temperature of coolant of the water jacket is lower than or equal to the prescribed temperature.

Accordingly, when the engine body is in operation and the temperature of the coolant in the water jacket is lower than or equal to a prescribed temperature, the coolant pump forcibly supplies the coolant in the water jacket from the exhaust gas cooling line to the EGR cooler, thereby appropriately cooling the heat transfer pipe and allowing the soot that has been stuck to be removed at an early stage.

A diesel engine of the present invention is provided with a coolant cooling line configured to cool the coolant of the water jacket of the engine body with a radiator and a coolant circulation pump provided in the coolant cooling line, wherein the coolant supply device is constituted of an exhaust gas cooling line configured to supply the coolant of the water jacket to the EGR cooler and a flow rate regulating valve provided in the coolant cooling line, and the control device decreases a degree of opening of the flow rate regulating valve when the engine body is in operation and a temperature of coolant of the water jacket is lower than or equal to the prescribed temperature.

Accordingly, when the engine body is in operation and the temperature of the coolant of the water jacket is lower than or equal to the prescribed temperature, the coolant of the water jacket can be more easily supplied from the exhaust gas cooling line to the EGR cooler by decreasing the degree of opening of the flow rate regulating valve. Thus, by simply employing the flow rate regulating valve, the heat transfer pipe can be appropriately cooled and the soot that has been stuck can be removed at an early stage, thereby suppressing an increase in the manufacturing cost.

In the diesel engine of the present invention, the coolant supply device is constituted of a coolant tank configured to store coolant, a coolant supply line configured to supply coolant in the coolant tank to the EGR cooler, and a coolant pump provided in the coolant supply line, and the control device activates the coolant pump when the engine body is in operation and a temperature of the engine body is lower than or equal to the prescribed temperature.

Accordingly, by providing the EGR cooler with a cooling system with use of a coolant supply line and a coolant pump, besides the water jacket for cooling the engine body, the cooling system of the EGR cooler may be activated as necessary, ensuring a greater degree of freedom to implement cleaning treatment of the EGR cooler.

In the diesel engine of the present invention, the control device activates the coolant supply device when an operating time of the engine body exceeds a preset prescribed operating time, and when the engine body is in operation and a temperature of the engine body is lower than or equal to the prescribed temperature.

Therefore, when an operating time of the engine body exceeded the prescribed operating time the coolant is supplied to the EGR cooler and the soot stuck to the heat transfer pipe is removed. This allows the cleaning treatment of the EGR cooler to be performed only when needed and enables the cooling capacity of the engine body to be maintained.

In the diesel engine of the present invention, the control device activates the coolant supply device when an open time of the EGR valve exceeds a preset prescribed open time, and when the engine body is in operation and a temperature of the engine body is lower than or equal to the prescribed temperature.

Therefore, when the open time of the EGR valve exceeds the prescribed open time, the coolant is supplied to the EGR cooler and the soot stuck to the heat transfer pipe is removed. This allows the cleaning treatment of the EGR cooler to be performed only when needed and enables the cooling capacity of the engine body to be maintained.

In the diesel engine of the present invention, the control device activates the coolant supply device when a temperature of exhaust gas discharged from the EGR cooler reaches or exceeds a preset prescribed temperature, and when the engine body is in operation and a temperature of the engine body is lower than or equal to the prescribed temperature.

Therefore, the coolant is supplied to the EGR cooler and the soot stuck to the heat transfer pipe is removed based on the determination that cooling capacity of the EGR cooler has declined when a temperature of exhaust gas discharged from the EGR cooler reaches or exceeds the prescribed temperature. This allows the cleaning treatment of the EGR cooler to be performed only when needed and enables the cooling capacity of the engine body to be maintained.

Advantageous Effect of Invention

According to the diesel engine of the present invention, performance reduction due to deposits on an EGR cooler can be suppressed.

DESCRIPTION OF EMBODIMENTS

Preferred embodiments of a diesel engine according to the present invention are described in detail below with reference to the attached drawings. Note that the present invention is not limited by these embodiments, and when a plurality of embodiments are present, the present invention is intended to include a configuration combining these embodiments.

First Embodiment

Figure 1:
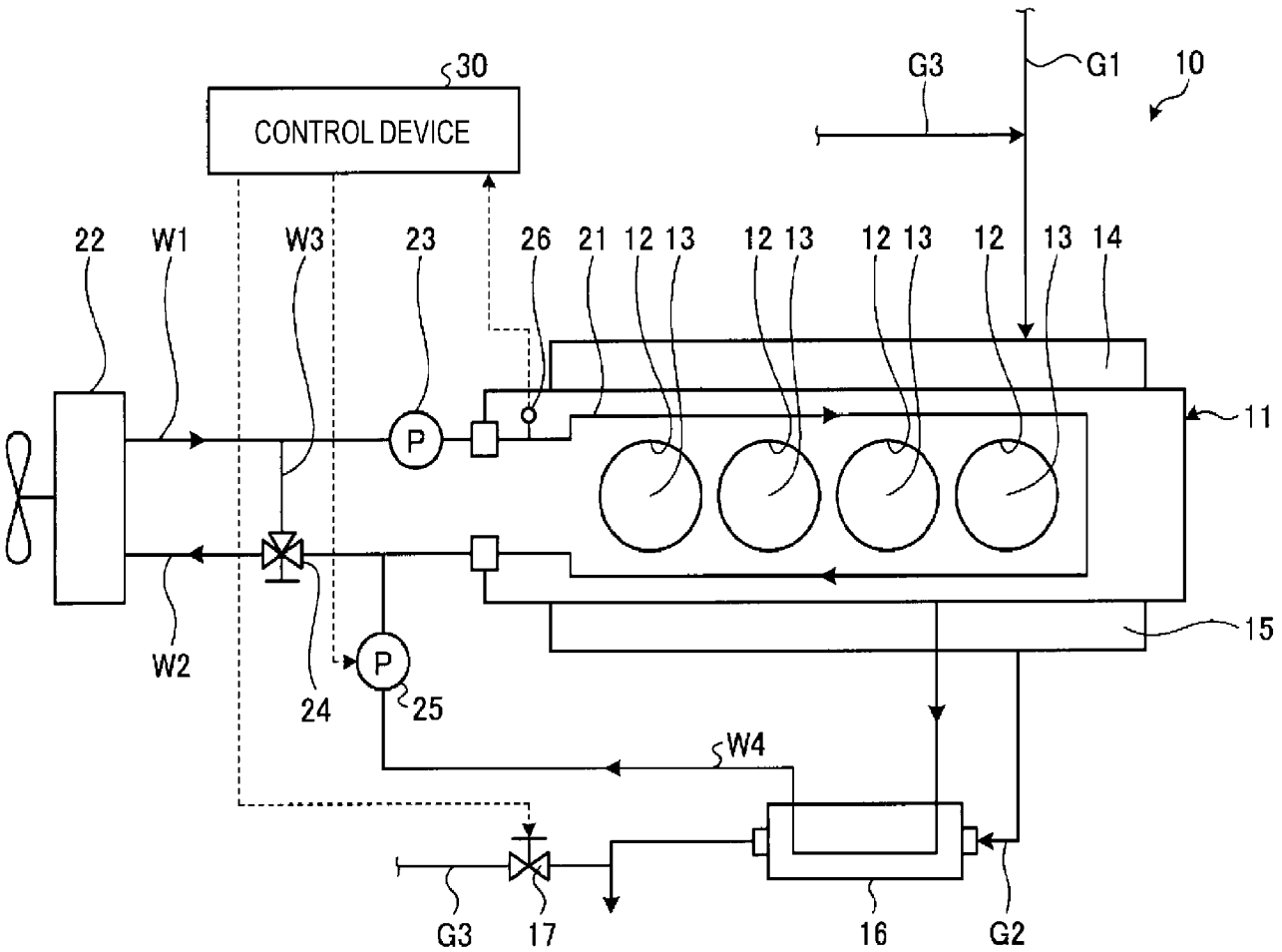
FIG. 1 is a schematic configuration diagram illustrating a diesel engine according to First Embodiment.

FIG. 1 is a schematic configuration diagram illustrating a diesel engine according to First Embodiment.

As illustrated in FIG. 1, in a diesel engine 10 of First Embodiment, a cylinder head is fastened on a cylinder block to form an engine body 11. The engine body 11 is provided with a plurality (four in the present embodiment) of cylinder bores 12. A piston 13 is supported to be movable upward and downward in each of the cylinder bores 12 via a cylinder liner (not illustrated). Although not illustrated in the figure, the engine body 11 has a lower portion rotatably supporting a crankshaft. Each piston 13 is connected to the crankshaft via a connecting rod.

The engine body 11 is provided with an air supply manifold 14 via an intake port (not illustrated) and is also provided with an exhaust manifold 15 via an exhaust port (not illustrated). Although not illustrated, an intake port and an exhaust port intake valve and an exhaust valve are disposed. The intake valve and the exhaust valve are capable of opening and closing the intake port and the exhaust port by being activated by an intake cam and an exhaust cam of an intake cam shaft and an exhaust cam shaft, which are not illustrated. In addition, the engine body 11 is provided with a fuel injection valve (not illustrated), and the fuel injection valve is capable of injecting a high-pressure fuel into a combustion chamber.

Accordingly, the diesel engine 10 is configured to perform four strokes (intake stroke, compression stroke, expansion stroke, and exhaust stroke) while the crankshaft rotates twice. In this process, the intake cam shaft and the exhaust cam shaft make one rotation, and the intake valve and the exhaust valve open and close the intake port and the exhaust port, respectively. Then, in the engine body 11, when the air is supplied to each combustion chamber from an air supply manifold 14 via each intake port, the air is compressed by the rise of each of the pistons 13, and when the high-pressure fuel is injected into the combustion chamber from each fuel injection valve, the high-pressure fuel self-ignites and burns. Then the generated combustion gas is discharged from each exhaust port to the exhaust manifold 15 as exhaust gas.

In the engine body 11, an air supply line G1 is connected to the air supply manifold 14, and an exhaust line G2 is connected to the exhaust manifold 15. An EGR line G3 has one end portion connected to the exhaust line G2 and the other end portion connected to the air supply line G1. This EGR line G3 is configured to introduce a portion of the exhaust gas into the air of the air supply line G1, and is provided with an EGR cooler 16 and an EGR valve 17.

The engine body 11 is provided with a water jacket 21 in which the coolant is circulated for cooling. The water jacket 21 is connected to a radiator 22 by a coolant inlet line (coolant cooling line) W1 and a coolant outlet line (coolant cooling line) W2. The coolant inlet line W1 is provided with a coolant circulation pump 23. Additionally, the coolant inlet line W1 and the coolant outlet line W2 are connected to each other by a bypass line W3, and a thermostat three-way valve 24 is provided at a connection portion between the coolant outlet line W2 and the bypass line W3.

The exhaust gas cooling line W4 is configured to introduce the coolant of the water jacket 21 into the EGR cooler 16 thereby cooling the exhaust gas. One end portion of the exhaust gas cooling line W4 is connected to the water jacket 21, and the other end portion thereof is connected to the coolant outlet line W2 at a position farther toward the water jacket 21 (engine body 11) side than the thermostat three-way valve 24. The exhaust gas cooling line W4 is provided with an electrically powered coolant pump 25.

The controller 30 is able to control the opening and closing of the EGR valve 17 and the activating and stopping of the coolant pump 25. Also, the engine body 11 is provided with a temperature sensor 26 configured to measure a temperature of the coolant in the water jacket 21. The temperature sensor 26 outputs a measurement result to the control device 30. Note that the coolant circulation pump 23 is provided in the engine body 11, which is operated to synchronize with the engine body 11, and the circulation amount of the coolant increases as the speed of the engine rotation increases. Also, the thermostat three-way valve 24 opens and closes in accordance with the temperature of the coolant, and for instance, when the coolant is in a low-temperature region (for example, 80° C. or lower), the coolant inlet line W1 is closed off causing the coolant outlet line W2 and the bypass line W3 to communicate with each other, and when the coolant is in a high-temperature region (for example, 80° C. or higher), the bypass line W3 is closed off causing the coolant outlet line W2 and the radiator 22 or the coolant inlet line W1 that follows the radiator 22 to communicate with each other.

By the way, the EGR cooler 16 is constituted of a large number of heat transfer pipes disposed in a case having a hollow shape, and the exhaust line G2 is connected to the case, and moreover the exhaust gas cooling line W4 is connected to the large number of heat transfer pipes. As a result, the exhaust gas is supplied from the exhaust line G2 into the case, the coolant is supplied to the large number of heat transfer pipes, and moreover heat exchange is performed between the exhaust gas in the case and the coolant in each of the heat transfer pipes, whereby the exhaust gas is cooled by the coolant. At this time, since the exhaust gas contains a particulate matter (PM), soot as the particulate matter may adhere to and deposit on the outer surface of each of the heat transfer pipes, resulting in reducing the efficiency of heat exchange between the exhaust gas and the coolant, and preventing the exhaust gas from being cooled sufficiently.

Therefore, in the present embodiment, when the engine body 11 is in operation, the EGR cooler 16 is configured to be regenerated by being supplied with coolant having a temperature lower than or equal to a prescribed temperature thereby removing soot adhered to and deposited on the outer surface of the heat transfer pipe. Since the exhaust gas contains water vapor, water vapor is trapped in the soot that has stuck to the outer surface of the heat transfer pipe. Therefore, by flowing coolant having a prescribed temperature (preferably 40° C. or lower) in the heat transfer pipe, the soot that has stuck to the outer surface thereof is cooled through the heat transfer pipe, and the water vapor therein is condensed into water. Since volume expansion occurs when water vapor turns into condensed water, the deposit layer of the soot stuck to the heat transfer pipe is more likely to be peeled off by being lifted by the condensed water produced therein. When the exhaust gas comes into contact with the soot deposit layer on the heat transfer pipe in this state, the peeling-off of the soot deposit layer is facilitated due to the contact pressure of the exhaust gas, and the soot is removed by being peeled off from the outer surface of the heat transfer pipe.

In the diesel engine 10 of the present embodiment, the control unit 30 activates the coolant supply device, when the engine body 11 is in operation and the temperature of the engine body 11, that is, the temperature of the coolant in the water jacket 21 is lower than or equal to a prescribed temperature, to supply the coolant at a low temperature to the EGR cooler 16. The soot deposit layer that has adhered to the outer surface of each of the heat transfer pipes inside the EGR cooler 16 is then cooled to peel off, and removed.

At this time, when the EGR valve 17 that is provided in the EGR line G3 is open, the soot deposit layer, which has become more likely to peel off after being cooled, on the heat transfer pipe comes into contact with the exhaust gas, whereby the peeling-off is facilitated by the contact pressure of the exhaust gas and the removal from the outer surface of the heat transfer pipe occurs.

In the present embodiment, the coolant stored in the water jacket 21 is used as coolant, and an exhaust gas cooling line W4 configured to supply the coolant of the water jacket 21 to the EGR cooler 16 and the coolant pump 25 provided in the exhaust gas cooling line W4 are used as a coolant supply device. Then, the control device 30 activates the coolant pump 25 when the engine body 11 is in operation and the temperature of the coolant of the water jacket 21 is lower than or equal to a prescribed temperature.

Figure 2:
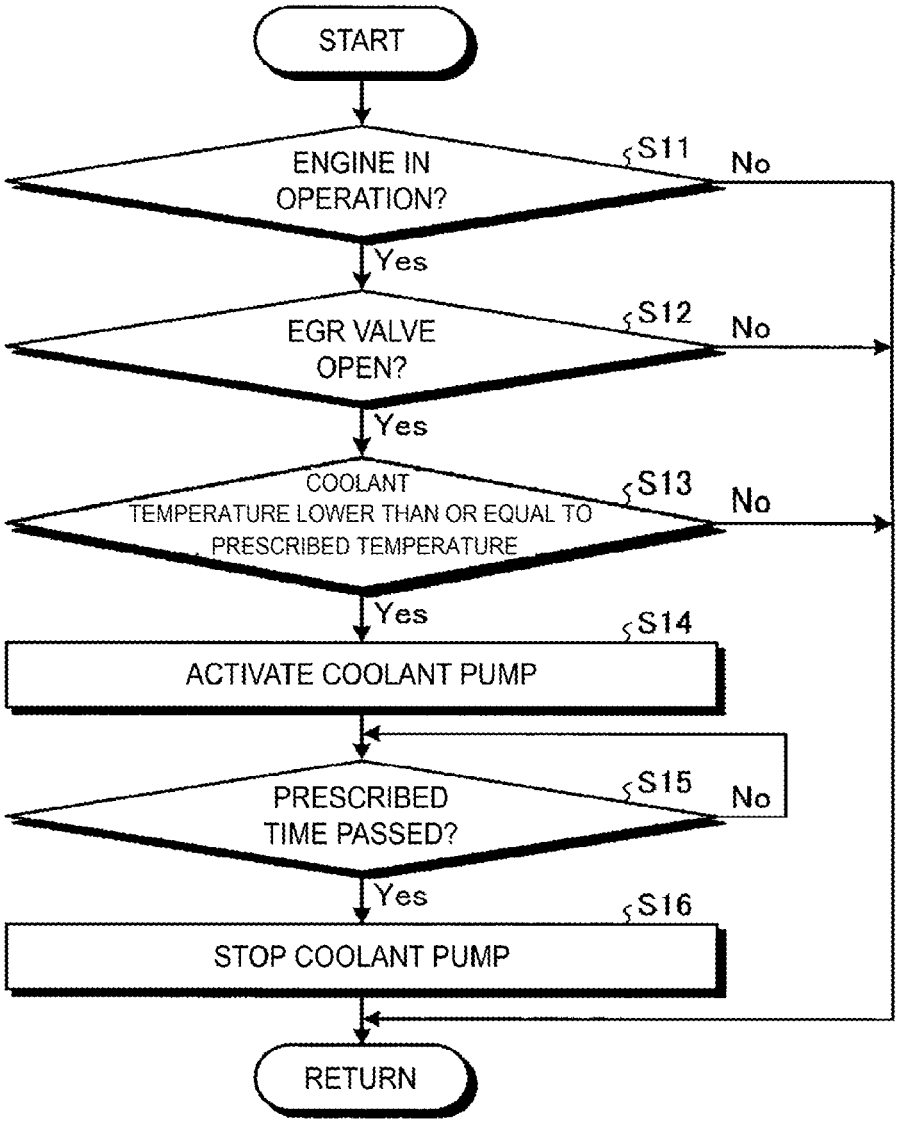
FIG. 2 is a flow chart illustrating a cleaning method for an EGR cooler.

Control of a cleaning method for the EGR cooler 16 in the diesel engine 10 of First Embodiment will be described in detail below. FIG. 2 is a flow chart illustrating the cleaning method of the EGR cooler.

As illustrated in FIGS. 1 and 2, in step S11, the controller 30 determines whether the engine body 11 is in operation. Operation of the engine body 11 may be determined, for example, on the basis of whether the engine speed exceeds 0. Here, when it is determined that the engine body 11 is not in operation (No), processing exits this routine without implementing anything. On the other hand, when it is determined that the engine body 11 is in operation (Yes), the controller 30 determines in step S12 whether the EGR valve 17 is open. Since the control device 30 performs an opening/closing control on the EGR valve 17 according to the operating state of the engine body 11, the open status of the EGR valve 17 may be determined by a control signal therefrom. Here, when the EGR valve 17 is determined as not open (No), processing exits this routine without implementing anything.

On the other hand, when the EGR valve 17 is determined to be open (Yes), the controller 30 determines in step S13 whether the temperature of the coolant in the water jacket 21 is lower than or equal to a prescribed temperature. The control device 30 determines whether the temperature of the coolant is lower than or equal to the prescribed temperature on the basis of an input value from the temperature sensor 26. Here, when the temperature of the coolant is determined to be higher than the prescribed temperature (No), processing exits the routine without implementing anything. On the other hand, when the temperature of the coolant is determined to be lower than or equal to the prescribed temperature (Yes), the control device 30 activates the coolant pump 25 in step S14.

When the coolant pump 25 is activated, the coolant of the water jacket 21 in a state of low temperature, i.e., a temperature lower than or equal to the prescribed temperature, is supplied to the EGR cooler 16 through the exhaust gas cooling line W4. Then, in the EGR cooler 16, by being cooled by the coolant, the soot deposit layer stuck to the heat transfer pipe is more likely to peel off as the water vapor therein turns into a condensed water and the volume expansion of the condensed water lifts up the deposit layer of the soot. Then, the soot deposit layer that has become more likely to peel off, is peeled off and removed from the outer surface of the heat transfer pipe by the exhaust gas flowing in the EGR cooler 16.

Note that in the engine body 11, the coolant circulation pump 23 is operated, hence the coolant of the water jacket 21 is supplied to the EGR cooler 16 through the exhaust gas cooling line W4. However, the coolant circulation pump 23 is operated in accordance with the rotational speed of the engine body 11, and when the rotational speed of the engine body 11 is low, the circulating amount of the coolant is also low. Furthermore, the coolant circulation pump 23 does not directly supply the coolant of the water jacket 21 from the exhaust gas cooling line W4 to the EGR cooler 16, hence it is difficult to sufficiently cool the heat transfer pipe of the EGR cooler 16. In the present embodiment, by activating the coolant pump 25 provided in the exhaust gas cooling line W4, the coolant in a low-temperature state is forcibly supplied from the exhaust gas cooling line W4 to the EGR cooler 16, thereby actively cooling and peeling off the soot deposit layer stuck to the heat transfer pipe of the EGR cooler 16.

Thereafter, in step S15, whether a prescribed amount of time has elapsed since the coolant pump 25 was activated is determined. This prescribed time is a time taken for the soot deposit layer, which is stuck to the heat transfer pipe, to peel off after the heat transfer pipe of the EGR cooler 16 is cooled by the coolant in a low temperature state, and this prescribed time is experimentally pre-determined. Here, when it is determined that a prescribed amount of time has not elapsed (No) since the coolant pump 25 was activated, this processing continues. On the other hand, when it is determined that a prescribed amount of time has elapsed (Yes) since the coolant pump 25 was activated, in step S16 the operation of the coolant pump 25 is stopped and the cleaning treatment of the EGR cooler 16 ends.

Note that in the above description, when the engine body 11 is in operation and the temperature of the coolant of the water jacket 21 is lower than or equal to a prescribed temperature, the coolant pump 25 is activated, the low-temperature coolant is supplied to the EGR cooler 16, and the soot adhered to the heat transfer pipe is cooled and peeled off. However, when the temperature of the coolant of the water jacket 21 is lower than or equal to the prescribed temperature, the low-temperature coolant does not always have to be supplied to the EGR cooler 16. In other words, this cleaning control is performed only when a prescribed amount of soot adhered to the heat transfer pipe significantly reduces the cooling performance.

For example, the coolant supply device is activated when the engine body 11 is in operation and the temperature of the engine body 11 is lower than or equal to a prescribed temperature and when the operating time of the engine body 11 exceeds a preset prescribed operating time after a cleaning control is performed. In this case, the prescribed operating time is a time taken until a significantly reduced cooling performance is exhibited since the soot is adhered to the heat transfer pipe in the EGR cooler 16, and this time may be experimentally preset.

Further, the coolant supply device is activated when the engine body 11 is in operation and the temperature of the engine body 11 is lower than or equal to a prescribed temperature, and when the EGR valve 17 open time exceeds a preset prescribed open time after the cleaning control is performed. In this case, the prescribed open time is a time taken until a significantly reduced cooling performance is exhibited since the soot adhered to the heat transfer pipe in the EGR cooler 16 during the time when the EGR valve 17 is open, and this time may be experimentally preset.

Furthermore, the coolant supply device is activated when the engine body 11 is in operation and the temperature of the engine body 11 is lower than or equal to a prescribed temperature, and when the temperature of the exhaust gas discharged from the EGR cooler 16 reaches a preset prescribed temperature or higher after the cleaning control is performed. In this case, the prescribed temperature is a temperature of the exhaust gas at which soot adheres to the heat transfer pipe in the EGR cooler 16, significantly reducing the cooling performance, and this temperature may be experimentally preset.

In this way, the diesel engine of First Embodiment includes, the EGR line G3 configured to recirculate a portion of exhaust gas, which has been discharged from an engine body 11, to the engine body 11 as a combustion gas, the EGR cooler 16 provided in the EGR line G3 and configured to cool an exhaust gas by coolant, a coolant supply device configured to supply coolant to the EGR cooler 16, and the control device 30 configured to activate the coolant supply device when the engine body 11 is in operation and a temperature of the engine body 11 is lower than or equal to a preset prescribed temperature.

Accordingly, the coolant is supplied to the EGR cooler 16 when the engine body 11 is in operation and a temperature of the engine body 11 is lower than or equal to a prescribed temperature. When the heat transfer pipe of the EGR cooler 16 is cooled by a low-temperature coolant, the soot that has stuck to the heat transfer pipe is cooled, and the water vapor therein is turned into condensed water. When the condensed water is produced in the soot, its volume expands and the deposit layer of the soot stuck to the heat transfer pipe becomes more likely to peel off by being lifted by the condensed water. Here, when the exhaust gas comes into contact with the soot deposit layer on the heat transfer pipe, the peeling-off of the soot deposit layer is facilitated due to the contact pressure of the exhaust gas, and the soot is removed by being peeled off from the outer surface of the heat transfer pipe. As a result, the performance reduction due to the deposit on the EGR cooler 16 can be suppressed.

In the diesel engine of the First Embodiment, the EGR valve 17 is provided in the EGR line G3, and the control device 30 is configured to activate the coolant supply device when the EGR valve 17 is open, when the engine body 11 is in operation and a temperature of the engine body 11 is lower or equal to the prescribed temperature. Therefore, since the exhaust gas comes into contact with the soot deposit layer in a state where the soot stuck to the heat transfer pipe is cooled and more likely to be peeled off, the contact pressure of the exhaust gas enables the soot to be removed from the outer surface of the heat transfer pipe at an early stage.

In the diesel engine of the First Embodiment, the coolant supply device includes the exhaust gas cooling line W4 configured to supply coolant of the water jacket 21 of the engine body 11 to the EGR cooler 16, and the coolant pump 25 provided in the exhaust gas cooling line W4, and the control device 30 activates the coolant pump 25 when the engine body 11 is in operation and the temperature of the coolant of the water jacket 21 is lower than or equal to a prescribed temperature. Accordingly, the coolant of the water jacket 21 is forcibly supplied from the exhaust gas cooling line W4 to the EGR cooler 16 by the coolant pump 25, thereby enabling the soot that has been adhered to be removed at an early stage by appropriately cooling the heat transfer pipe.

In the diesel engine of the First Embodiment, the control device 30 supplies coolant to the EGR cooler 16 on the basis of determination that the soot has adhered to the heat transfer pipe and that the cooling capacity of the EGR cooler 16 has decreased, when the operating time of the engine body 11 exceeded a preset prescribed operating time, or when the open time of the EGR valve 17 exceeded the preset prescribed open time, or when the temperature of the exhaust gas discharged from the cooler 16 has reached or exceeded a preset prescribed temperature. Accordingly, this allows the cleaning treatment in the EGR cooler 16 to be performed only when necessary, enabling the utilization of the coolant of the water jacket 21 to be reduced and the cooling capacity of the engine body 11 to be maintained.

Second Embodiment

Figure 3:
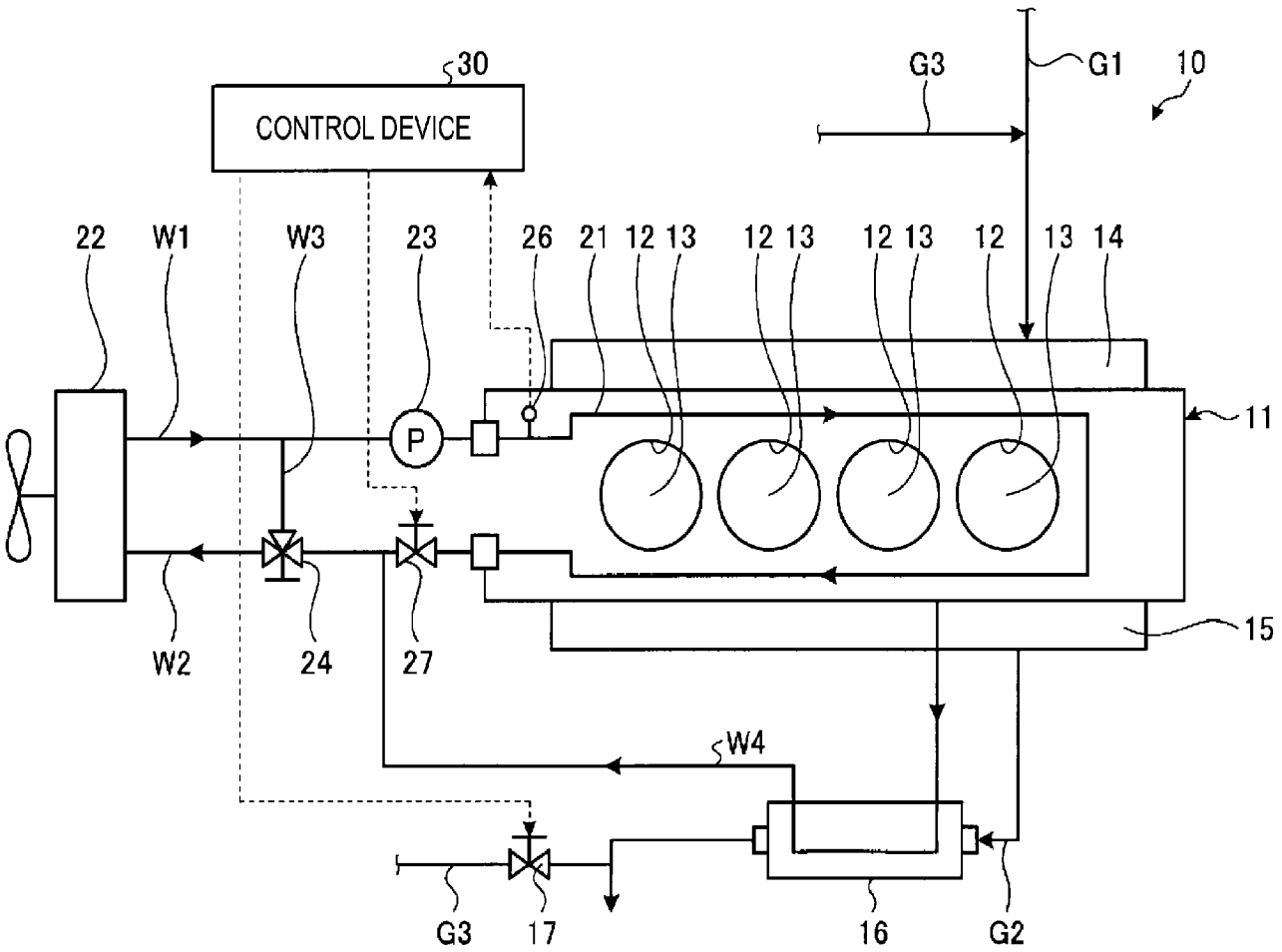
FIG. 3 is a schematic configuration diagram illustrating a diesel engine according to Second Embodiment.

FIG. 3 is a schematic configuration diagram illustrating a diesel engine according to a Second Embodiment. Note that the same reference numerals are given to members having the same functions as the embodiments described above and detailed description thereof will be omitted.

In the Second Embodiment, as illustrated in FIG. 3, the engine body 11 is provided with the water jacket 21, which is connected to the radiator 22 by the coolant inlet line W1 and the coolant outlet line W2, and the coolant circulation pump 23 is provided in the coolant inlet line W1. One end portion of the exhaust gas cooling line W4 is connected to the water jacket 21, and the other end portion thereof is connected to the coolant outlet line W2 at a position farther toward the water jacket 21 side than the thermostat three-way valve 24. The flow rate regulating valve 27 is provided in the coolant outlet line W2 at a position farther toward the water jacket 21 side than a connection portion of the exhaust gas cooling line W4.

The control device 30 is capable of controlling the opening/closing operation of the EGR valve 17 and adjusting a degree of opening of the flow rate regulating valve 27. Also, the engine body 11 is provided with the temperature sensor 26 configured to measure the temperature of the coolant in the water jacket 21. The temperature sensor 26 outputs a measurement result to the control device 30.

In the present embodiment, when the engine body 11 is in operation, the EGR cooler 16 is configured to be regenerated by being supplied with coolant having a temperature lower than or equal to a prescribed temperature, thereby removing soot adhered to and deposited on the outer surface of the heat transfer pipe. The control unit 30 activates the coolant supply device when the engine body 11 is in operation and the temperature of the engine body 11, that is, the temperature of the coolant in the water jacket 21, is lower than or equal to a prescribed temperature, to supply a low-temperature coolant to the EGR cooler 16. The soot deposit layer that has adhered to the outer surface of each of the heat transfer pipes inside the EGR cooler 16 is then cooled to peel off, and removed.

In the present embodiment, the coolant stored in the water jacket 21 is used as coolant, and an exhaust gas cooling line W4 configured to supply coolant of the water jacket 21 to the EGR cooler 16 and the flow rate regulating valve 27 provided in the coolant outlet line W2 are employed as the coolant supply device. Then, the control device 30 reduces the degree of opening of the flow rate regulating valve 27 when the engine body 11 is in operation and the temperature of the coolant of the water jacket 21 is lower or equal to a prescribed temperature. When the degree of opening of the flow rate regulating valve 27 is decreased, the flow rate of the coolant flowing from the water jacket 21 through the coolant outlet line W2 to the radiator 22 decreases, and the flow rate of the coolant flowing from the water jacket 21 to the exhaust gas cooling line W4 increases. Therefore, the cooling performance of each of the heat transfer pipes inside the EGR cooler 16 increases, and the soot deposit layer that has adhered to the outer surface of the heat transfer pipe is cooled to peel off, and removed.

At this time, the control device 30 adjusts the degree of opening of the flow rate regulating valve 27 in accordance with the temperature of the coolant that is input from the temperature sensor 26 and the rotational speed of the engine body 11. The control device 30 increases the degree of opening of the flow rate regulating valve 27 when the temperature of the coolant increases or the rotational speed of the engine body 11 increases.

In addition, when the EGR valve 17 provided in the EGR line G3 is open, the soot deposit layer, which has been cooled and become more likely to be peeled off, on the heat transfer pipe comes into contact with the exhaust gas, whereby the peeling-off is facilitated by the contact pressure of the exhaust gas and the removal from the outer surface of the heat transfer pipe occurs.

Note that the control of a method of cleaning the EGR cooler 16 in the diesel engine 10 of Second Embodiment is substantially the same as that of First Embodiment, and thus descriptions thereof will be omitted.

Thus, in the diesel engine of the Second Embodiment, the coolant inlet line W1 and the coolant outlet line W2, which are configured to cool the coolant of the water jacket 21 of the engine body 11 by a radiator 22, and a coolant circulation pump 23, which is provided in the coolant outlet line W2, are provided, and the exhaust gas cooling line W4, which is configured to supply the coolant of the water jacket 21 to the EGR cooler 16 and the flow rate regulating valve 27, which is provided in the coolant outlet line W2, are provided as the coolant supply device, and moreover, the control device 30 reduces the degree of opening of the flow rate regulating valve 27 when the engine body 11 is in operation and the temperature of the coolant of the water jacket 21 is lower than or equal to the prescribed temperature.

Accordingly, by decreasing the degree of opening of the flow rate regulating valve 27, the coolant of the water jacket 21 can be more easily supplied from the exhaust gas cooling line W4 to the EGR cooler 16. Thus, by simply employing the flow rate regulating valve 27, the heat transfer pipe can be appropriately cooled and the soot that has been adhered can be removed at an early stage, thereby suppressing an increase in the manufacturing cost.

Third Embodiment

Figure 4:
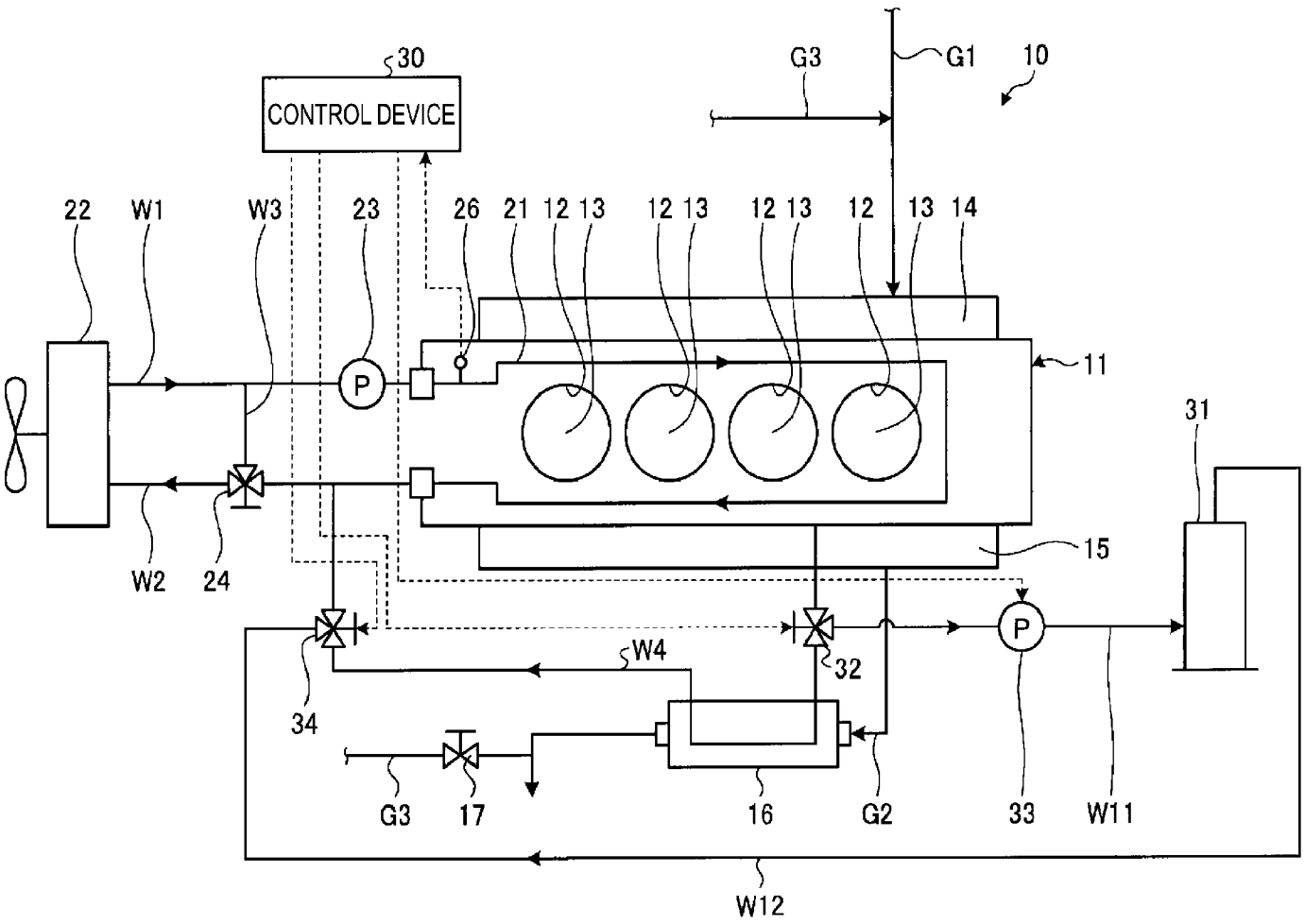
FIG. 4 is a schematic configuration diagram illustrating a diesel engine according to Third Embodiment.

FIG. 4 is a schematic configuration diagram illustrating a diesel engine according to a Third Embodiment. Note that the same reference numerals are given to members having the same functions as the embodiments described above and detailed description thereof will be omitted.

In the Third Embodiment, as illustrated in FIG. 4, when the engine body 11 is in operation, the EGR cooler 16 is configured to be regenerated by being supplied with coolant having a temperature lower than or equal to a prescribed temperature, thereby removing soot adhered to and deposited on the outer surface of the heat transfer pipe. The control unit 30 activates the coolant supply device when the engine body 11 is in operation and the temperature of the engine body 11, that is, the temperature of the coolant in the water jacket 21, is lower than or equal to a prescribed temperature, to supply a low-temperature coolant to the EGR cooler 16. The soot deposit layer that has adhered to the outer surface of each of the heat transfer pipes inside the EGR cooler 16 is then cooled to peel off, and removed.

In the present embodiment, the coolant stored in the water jacket 21 to serve as coolant is stored as a temporary stored water, and a cooling system which is separate from the cooling system of the engine body 11, are provided. More specifically, a coolant tank 31 is connected, by the first coolant supply line W11, to the upstream side of the EGR cooler 16 in the exhaust gas cooling line W4, namely, to the water jacket 21 side. The first coolant supply line W11 is provided with: the three-way selector valve 32 at a portion of connection with the exhaust gas cooling line W4; and a coolant pump 33. In addition, the coolant tank 31 is connected, by the second coolant supply line W12, to the downstream side of the EGR cooler 16 in the exhaust gas cooling line W4, namely, to the coolant outlet line W2 side. The second coolant supply line W12 is provided with a three-way selector valve 34 at a portion of connection with the exhaust gas cooling line W4.

Namely, the coolant tank 31 configured to store the coolant, the first coolant supply line W11 and the second coolant supply line W12 configured to supply the coolant of the coolant tank 31 to the EGR cooler 16, and the coolant pump 33 provided in the first coolant supply line W11, are employed as the coolant supply device. Then, the control unit 30 activates the coolant pump 33 when the engine body 11 is in operation and the temperature of the coolant of the water jacket 21 is lower than or equal to a prescribed temperature.

In other words, first, the flow path on the water jacket 21 side of the exhaust gas cooling line W4 is closed off by the three-way selector valve 32, and the EGR cooler 16 side of the exhaust gas cooling line W4 and the first coolant supply line W11 are caused to communicate with each other. In addition, the flow path on the coolant outlet line W2 side of the exhaust gas cooling line W4 is closed off by the three-way selector valve 34, and the EGR cooler 16 side of the exhaust gas cooling line W4 and the second coolant supply line W12 are caused to communicate with each other. Next, the coolant pump 33 is activated. Then, the coolant in the coolant tank 31 is supplied from the three-way selector valve 34 to the EGR cooler 16 of the exhaust gas cooling line W4 through the second coolant supply line W12. Here, with the heat transfer pipe of the EGR cooler 16 being cooled by the coolant, the soot deposit layer adhered to the outer surface of the heat transfer pipe is cooled and removed.

At this time, when the EGR valve 17 that is provided in the EGR line G3 is open, the soot deposit layer, which has become more likely to be peeled off after being cooled, on the heat transfer pipe comes into contact with the exhaust gas, whereby the peeling-off is facilitated by the contact pressure of the exhaust gas and the removal from the outer surface of the heat transfer pipe occurs.

The cleaning treatment of the EGR cooler 16 of the present embodiment is preferably performed when a diesel particulate filter (DPF) is regenerated. The diesel particulate filter is a device for collecting and removing particulate matter and black smoke contained in the exhaust gas of the diesel engine 10. In addition, the diesel particulate filter causes trapped particulate matter and black smoke to undergo combustion by raising the temperature of the exhaust gas before the filter is clogged. At this time, the heat transfer pipe is cooled by supplying the coolant to the EGR cooler 16, and the soot deposit layer adhered to the outer surface of the heat transfer pipe is removed.

Note that the control of the method of cleaning the EGR cooler 16 in the diesel engine 10 of Third Embodiment is substantially the same as that of First Embodiment, and thus descriptions thereof will be omitted.

Thus, in the diesel engine of Third Embodiment, as the coolant supply device, the coolant tank 31 configured to store coolant, the first coolant supply line W11 and the second coolant supply line W12 configured to supply the coolant of the coolant tank 31 to the EGR cooler 16, and the coolant pump 33 provided in the first coolant supply line W11 are provided, and the control device 30 activates the coolant pump 33 when the engine body 11 is in operation and the temperature of the coolant in the water jacket 21 is lower than or equal to a prescribed temperature.

Therefore, by providing the EGR cooler 16 with the cooling system, which includes the first coolant supply line W11, the second coolant supply line W12, and the coolant pump 33, separately from the cooling system for the water jacket 21 for cooling the engine body 11, the cooling system of the EGR cooler 16 may be activated as necessary, thereby ensuring a greater degree of freedom to implement cleaning treatment of the EGR cooler 16.

REFERENCE SIGNS LIST

10 Diesel engine
11 Engine body
16 EGR cooler
17 EGR valve
21 Water jacket
22 Radiator
23 coolant circulation pump
24 Thermostat three way valve
25 coolant pump (coolant supply device)
26 Temperature sensor
27 Flow rate regulating valve (coolant supply device)
30 Control device
31 coolant tank (coolant supply device)
32, 34 Three way selector valve

33 coolant pump (coolant supply device)
G1 Air supply line
G2 Exhaust line
G3 EGR Line
W1 coolant inlet line (coolant cooling line)
W2 coolant outlet line (coolant cooling line)
W3 Bypass line
W4 Exhaust gas cooling line (coolant supply device)
W11 First coolant supply line (coolant supply device)
W12 Second coolant supply line (coolant supply device)

The invention claimed is:

1. A diesel engine, comprising:

an EGR line configured to recirculate a portion of exhaust gas, discharged from an engine body, to the engine body as a combustion gas;

an EGR cooler provided in the EGR line and configured to cool exhaust gas by coolant;

a coolant supplier configured to supply coolant to the EGR cooler;

a temperature sensor configured to measure a temperature of coolant in a water jacket of the engine body; and a controller configured to increase an amount of supply of coolant to the EGR cooler, wherein the coolant supplier comprises:

an exhaust gas cooling line configured to supply coolant of the water jacket of the engine body to the EGR cooler;

a first coolant supply line connected to the exhaust gas cooling line via a first three-way selector valve;

a coolant tank provided in the first coolant supply line and configured to store coolant:

a second coolant supply line configured to supply coolant of the coolant tank to the EGR cooler via a second three-way selector valve; and a coolant pump provided in the first coolant supply line, and the controller is configured to activate the coolant pump when the engine body is in operation and the temperature of coolant of the water jacket is lower or equal to a prescribed temperature.

2. The diesel engine according to claim 1, wherein an EGR valve is provided in the EGR line, and the controller is configured to activate the coolant pump when the EGR valve is open, when the engine body is in operation and the temperature of the coolant of the water jacket is lower or equal to the prescribed temperature.

3. The diesel engine according to claim 1, wherein the is configured to activate the coolant pump when the engine body is in operation and the temperature of the coolant of the water jacket is lower or equal to the prescribed temperature.

4. The diesel engine according to claim 1, wherein the controller is configured to activate the coolant pump when an operating time of the engine body exceeds a body is lower or equal to the prescribed temperature.

5. The diesel engine according to claim 2, wherein the controller is configured to activate the coolant pump when an open time of the EGR valve exceeds a preset prescribed open time, and when the engine body is in operation and the temperature of the coolant of the water jacket is lower or equal to the prescribed temperature.

6. The diesel engine according to claim 1, wherein the controller is configured to activate the coolant pump when a temperature of exhaust gas discharged from the EGR cooler reaches or exceeds a preset prescribed temperature, and when the engine body is in operation and the temperature of the coolant of the water jacket is lower or equal to the prescribed temperature.

7. The diesel engine according to claim 2, wherein the is configured to activate the coolant pump when the engine body is in operation and the temperature of the coolant of the water jacket is lower or equal to the prescribed temperature.

8. The diesel engine according to claim 2, wherein the controller is configured to activate the coolant pump when an operating time of the engine body exceeds a preset prescribed operating time, and when the engine body is in operation and the temperature of the coolant of the water jacket is lower or equal to the prescribed temperature.

9. The diesel engine according to claim 3, wherein the is configured to activate the coolant pump when an operating time of the engine body exceeds a preset prescribed operating time, and when the engine body is in operation and the temperature of the coolant of the water jacket is lower or equal to the prescribed temperature.

10. The diesel engine according to claim 2, wherein the controller is configured to activate the coolant pump when a temperature of exhaust gas discharged from the EGR cooler reaches or exceeds a preset prescribed temperature, and when the engine body is in operation and the temperature of the coolant of the water jacket is lower or equal to the prescribed temperature.

11. The diesel engine according to claim 3, wherein the is configured to activate the coolant pump when a temperature of exhaust gas discharged from the EGR cooler reaches or exceeds a preset prescribed temperature, and when the engine body is in operation and the temperature of the coolant of the water jacket is lower or equal to the prescribed temperature.

12. The diesel engine according to claim 4, wherein the controller is configured to activate the coolant pump when a temperature of exhaust gas discharged from the EGR cooler reaches or exceeds a preset prescribed temperature, and when the engine body is in operation and the temperature of the coolant of the water jacket is lower or equal to the prescribed temperature.

* * * * *